United States Patent [19]

Pelz

[11] Patent Number: 4,688,798

[45] Date of Patent: Aug. 25, 1987

[54] GOLF CLUB AND HEAD INCLUDING ALIGNMENT INDICATORS

[76] Inventor: David T. Pelz, 37 Tamarisk Cir., Abilene, Tex. 79605

[21] Appl. No.: 787,109

[22] Filed: Oct. 15, 1985

[51] Int. Cl.[4] ..... A63B 69/36

[52] U.S. Cl. ..... 273/164; 273/168; 273/169; 273/80 C

[58] Field of Search ..... D21/219; 273/163 R, 273/163 A, 164, 183 D, 183 C, 186 A, 186 C, 167 F, 168, 169, 171; 40/317

[56] References Cited

U.S. PATENT DOCUMENTS

| | | | |
|---|---|---|---|
| D. 245,437 | 8/1977 | Thiel | D21/219 |
| 1,485,272 | 2/1924 | Kinsman | 273/164 |
| 1,526,951 | 2/1925 | Beaumont | 273/163 R |
| 2,447,967 | 8/1948 | Stone | 273/164 |
| 3,333,854 | 8/1967 | White | 273/164 |
| 3,343,839 | 9/1967 | Borah | 273/164 X |
| 3,708,172 | 1/1973 | Rango | 273/164 |
| 3,779,398 | 12/1973 | Hunter | 273/164 X |
| 3,884,477 | 5/1975 | Bianco | 273/183 D |
| 3,918,720 | 11/1975 | Gordos | 273/183 C |
| 4,278,254 | 7/1981 | Simjian | 273/183 C |
| 4,411,431 | 10/1983 | Judice | 273/183 C |

FOREIGN PATENT DOCUMENTS

| | | | |
|---|---|---|---|
| 109891 | 10/1917 | United Kingdom | 273/163 R |

*Primary Examiner*—George J. Marlo
*Attorney, Agent, or Firm*—N. J. Aquilino

[57] ABSTRACT

A putter type golf club alignment system wherein a ball to be struck forms an extension of the alignment indicia on the golf club to provide an indication that the putter head is properly aligned with the ball and the intended target line, including a putter club head, having an upper surface, and a ball striking face wherein the upper surface of the club head is provided with a plurality of simulated golf balls aligned in a row perpendicular to the ball striking face, the simulated balls in use forming a straight line row with the ball to be struck when the putter is properly aligned.

15 Claims, 12 Drawing Figures

GOLF CLUB AND HEAD INCLUDING ALIGNMENT INDICATORS

BACKGROUND OF THE INVENTION

The present invention relates to a golf club alignment system and more particularly to an alignment system for a putter type golf club.

In the game of golf perhaps the single most important stroke is a putt where the ball is hit into the hole to determine the score for the player. The putt requires accuracy in the force of the stroke as well as in the direction the ball is struck in order for it to end up in the hole. In this regard, alignment of the putter head relative to the intended target line becomes of primary importance since a mis-aligned golf club will require an adjustment in the stroke in order to hit the ball into the hole. Proper alignment of a golf club to both a ball and an intended target line is one of the most prevalent problems existing in the game of golf today.

Various types of alignment systems are known in the prior art of golf clubs. Sighting line and sighting devices have been used on and in combination with golf putter heads. Among the better known prior art alignment devices for putters are those shown in the patent to McCabe, U.S. Pat. No. 3,880,430. Other related prior art are shown in U.S. Pat. Nos. to Delgadillo, D230,615, McCord D241,563, Boyce, 1,654,916, Borah 3,343,839, White 3,333,854, Antonious 3,408,074 and Bianco 3,884,477.

The proper alignment of a golf club and ball relative to the golf club and the proper alignment the club head itself relative to a target line is a twofold process. First the ball must be properly positioned with respect to the ideal point of impact on the golf club striking face at the center of percussion. Then the golf club must be properly aligned with the intended target line.

Many of the prior art alignment devices of the type described above have aided golfers in those alignment processes, however, difficulties nonetheless arise when certain players attempt to align a round golf ball with a point, line or another single representation of a golf ball. There is no precise point of reference with which to make a proper straight line alignment because two objects which are aligned or placed together provide a straight line in an infinite number of positions relative to one another. In the case where a straight line is used to be aligned with a round object, it is helpful but nonetheless difficulties arise aligning objects of one shape with another. On the other hand, it is a rather simple optical exercise for the human eye to align an element or object in a straight line with a previously established straight line of identical shaped or dimensioned elements. This is true with a golf ball which easily can be aligned in a row with a previously aligned row of balls or simulated golf balls to form an extended straight line. This concept is used in the present alignment system.

SUMMARY OF THE INVENTION

The present invention is directed to a putter type golf club having an improved alignment system. The alignment system incorporates the ball to be struck which forms an extension of the alignment indicia on the golf club.

The alignment system incorporates the ability of the human optical system to align a plurality of objects in a row. The system provides a golf club head, including a fixed representation of a plurality of golf balls on the upper surface thereof, which are in a straight line and orientated perpendicular to the club striking face. The balls are aligned with the golf ball to be struck, in order to provide an extended row of golf balls in a straight line in the direction of the target. The golf ball representations on the putter preferably will be in the form of three dimensional, dimpled ball surfaces. Alternately the balls on the club head may be in the form of essentially two-dimensional golf ball designs on a relatively flat surface of the club head or a longitudinal line having identical dimensions to the width of the ball to be struck.

The present invention permits a golfer to place the ball relative to the previously established line of balls on the putter, thereby automatically positioning the ball at the center of percussion of the putter, and permits the golfer to use the extended line of balls formed therefrom, for more easily aiming the club at the intended target line.

One of the objects of the present invention is to provide a putter whereby the ball may be readily positioned opposite to center of percussion of the golf club. Another of the objects of the present invention is to provide a putter type golf club with an improved alignment system which simulates a row of golf balls in a straight line in the direction a ball is to be struck when the alignment is properly made.

The invention and its objects will be more readily understood from the following specification and accompanying drawings.

DESCRIPTION OF THE PREFERRED EMBODIMENTS

Figure 1:
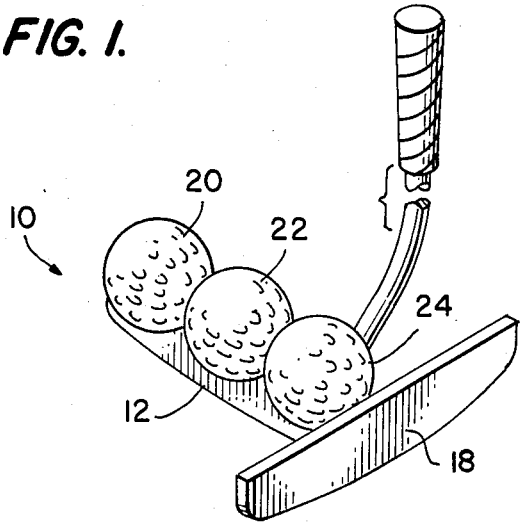
FIG. 1 is a perspective view of the putter head of the present invention.
Figure 2:
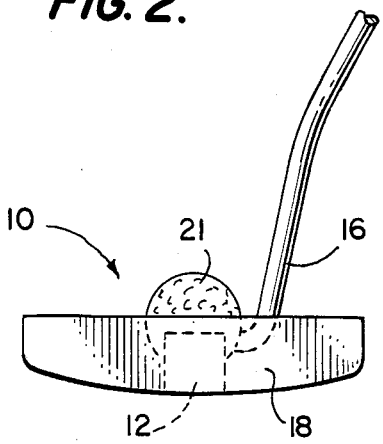
FIGS. 2 is front elevational view of the putter head of FIG. 1.
Figure 3:
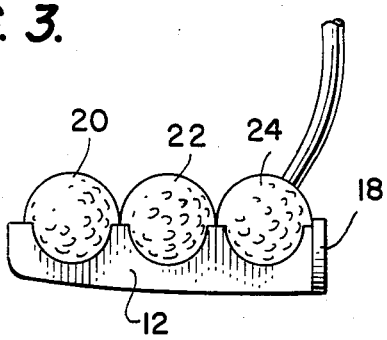
FIG. 3, is a side elevational view of the putter head of FIG. 1.
Figure 4:
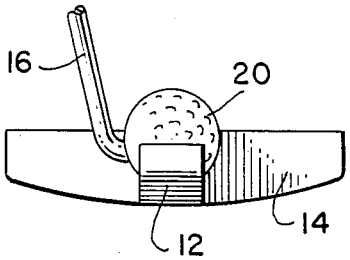
FIG. 4 is a rear elevational view of the putter head of FIG. 1.
Figure 5:
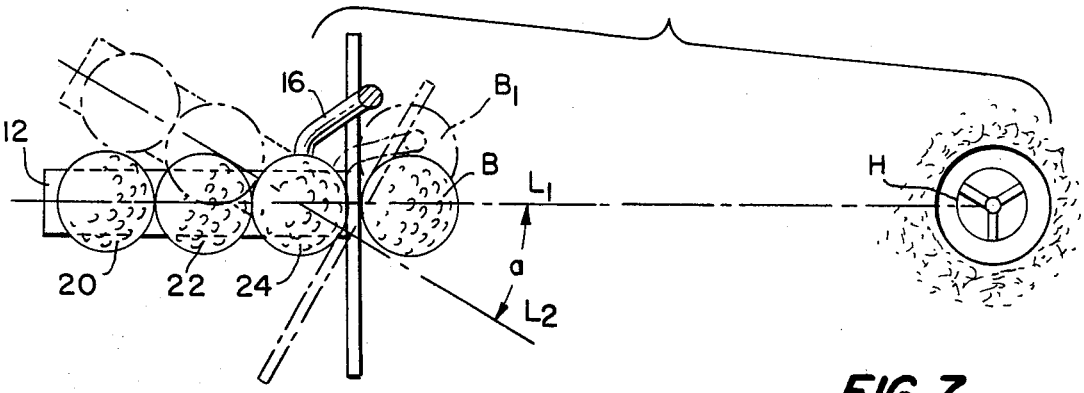
FIG. 5 is a top plan view of the putter head of FIG. 1.

Referring to FIGS. 1 to 5 of the drawing, a first embodiment of a putter type golf club 10 includes a body 12, a forward wing like member 14, a shaft 16 and a ball striking face 18. The upper surface of the body 12 is provided with a plurality of three dimensional simulated golf balls 20, 22 and 24. The balls are arranged in a row so that a straight line L1 passes through the center of each of the balls 20, 22 and 24 and through the percussion center of the putter head, and is perpendicular to the striking face 18. Referring to FIG. 5, when a golf ball B which is to be struck by the golf club 10 is properly aligned with the three balls 20, 22 and 24, the line L1, passes directly through the center of the Ball B.

Since the center of percussion is on the line L1, through the simulated balls 20, 22 and 24, it becomes readily apparent that a ball B1, shown in phantom and mis-aligned with line L1, would also be offset from the center of percussion. If an extended line formed by the entire golf club 10 (also shown in phantom) and the ball B1 is mis-aligned from the intended target line L1, this misalignment becomes readily apparent to the human eye. By using the three balls 20, 22 and 24 and the fourth ball B to be struck, the extended row of balls, formed by this proper alignment, is readily aimed at a hole H and it is a relatively simple matter to manipulate the golf club 10 until the desired direction toward the hole H is visually achieved.

Figure 6:
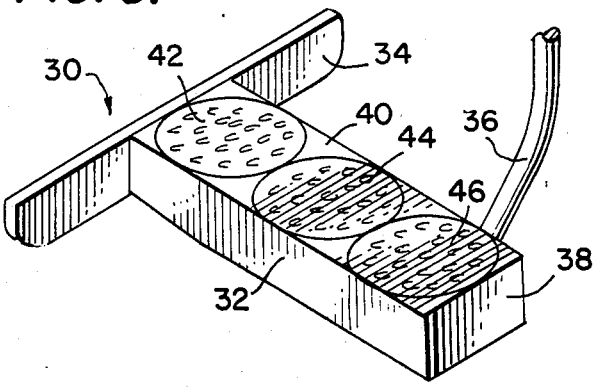
FIG. 6 is a perspective view of another embodiment of a putter head of the present invention.
Figure 7:
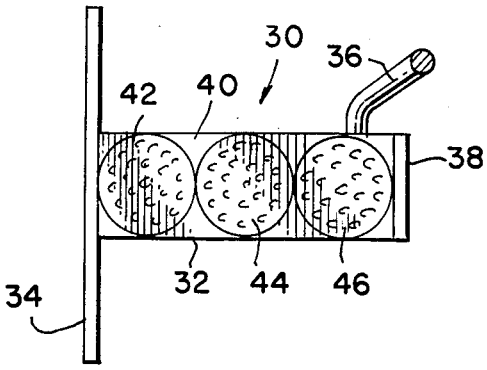
FIG. 7 is a top plan view of the putter head of FIG. 6.

FIGS. 6 and 7 show a second embodiment of a putter type golf club 30 of the present invention including a body 32, a rearward wing-like member 34, a shaft 36 and a ball striking face 38. In this embodiment the body 32 is generally rectangular in shape and includes an essentially flat upper surface 40, which is provided with a visual two-dimensional simulation of a plurality of golf balls 42, 44 and 46. The simulation of golf balls is created, for example, by painting or applying decals on the upper surface 40 of the golf club 30.

It will be appreciated that the similar visual effect will be created with the two dimensional balls 42, 44 and 46 as with the three dimensional design of FIGS. 1 to 5 and this embodiment is used the same way to properly align the golf club 30 with the ball and target line.

Figure 8:
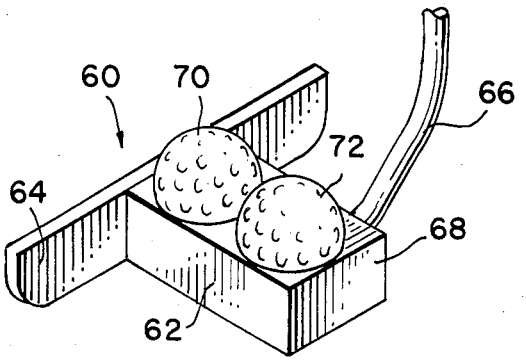
FIG. 8 is a perspective view of a third embodiment of the putter head of the present invention.

FIG. 8 shows still another embodiment of a putter type golf club 60 of the present invention including a body 62, a rearward wing-like member 64, a shaft 66 and a ball striking face 68. In this embodiment the upper surface of the body 62 carries only two simulated golf balls 70 and 72, which are shown in the three dimensional form; although it will be appreciated that a two-dimensional form of the type shown in FIGS. 6 and 7 would be equally applicable. The two ball simulation on the top of the golf club 60 operates in the same way as a three ball embodiment although it is somewhat more difficult to visualize a straight line using only two balls on the golf club 60.

Figure 9:
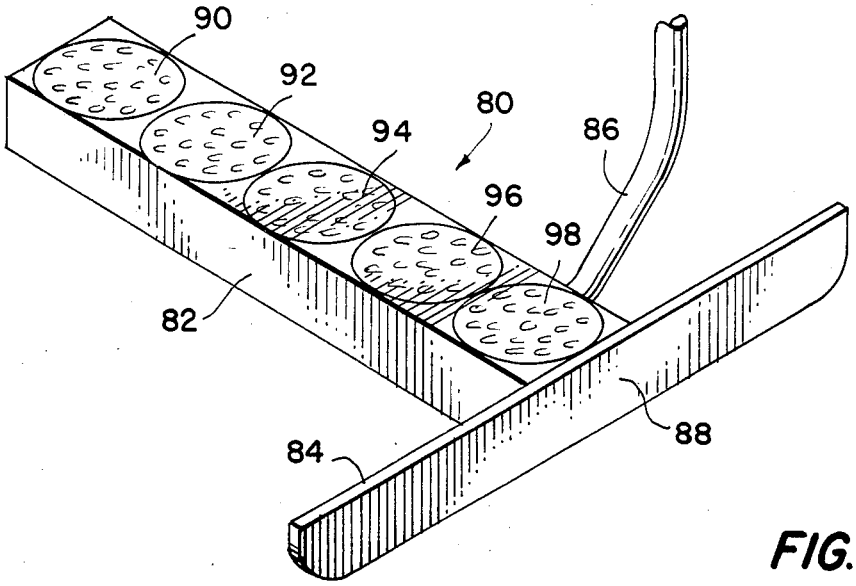
FIG. 9 is a perspective view of a fourth embodiment of the putter head of the present invention.

FIG. 9 shows a fourth embodiment of a putter type golf club 80 of the present invention including a body 82, a forward wing-like member 84, a shaft 86 and a ball striking face 88. In this embodiment the upper surface of the body 82, carries five simulated golf balls 90, 92, 94, 96 and 98 shown in a two-dimensional form. As with the other embodiments, two-dimensional and three-dimensional simulations of golf balls are interchangable. The club head 80 operates in the same way as the three ball embodiment although the larger number of simulated balls make it somewhat easier to align the club head 80 toward a target and to align it with a ball (not shown) with the larger number of simulated balls.

Figure 10:
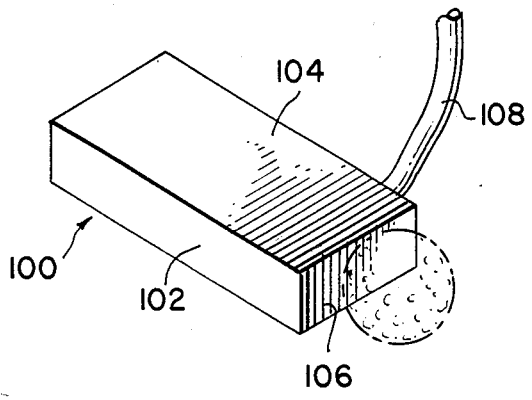
FIG. 10 is a perspective view of a fifth embodiment of the putter head of the present invention.

FIG. 10 illustrates a fifth embodiment of a putter type golf club 100 of the present invention including an elongated rectangular body 102 having an upper surface 104 and a ball striking face 106. A suitable shaft 108 is connected to the body 102 as shown. The width of the upper surface 104 is preferably identical, or nearly so to the diameter of a golf ball, namely 1.68 inches. The upper surface 104 may be white, optic orange, optic yellow or any other color in order to optically conform to the color of the ball. With this structure, the upper surface 104 will act as alignment indicia which can be aligned with a ball because of the similar dimensions and which can be used with the ball as an extension of the indicia for alignment purposes toward the target.

Figure 11:
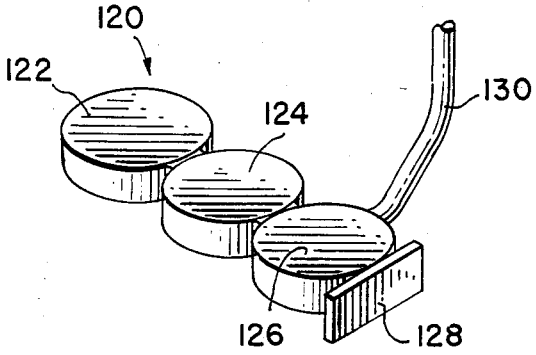
FIG. 11 is a perspective view of a sixth embodiment of the putter head of the present invention.

FIG. 11 shows a sixth embodiment of the putter type golf club 120 of the present invention including a plurality of discs 122, 124 and 126 which are dimensioned to simulate the diameter of a golf ball. The club 10 includes a ball striking face 128 and a shaft 130. Each disc preferably would be the color of a golf ball and may include a dimple pattern to further simulate a plurality of golf balls aligned in a row.

Figure 12:
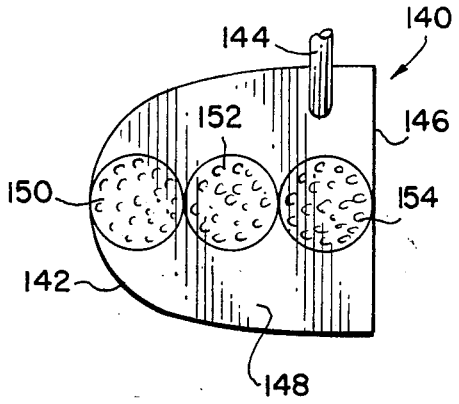
FIG. 12 is a top plan view of a seventh embodiment of the putter head of the present invention.

FIG. 12 shows a more conventional type golf club head 140 including a body 142 having a shaft 144 and a ball striking face 146. The upper surface 148 includes a series of simulated golf balls 150, 152 and 154. The club head 140 is aligned with a golf ball to be struck and target line as described herein above.

Other changes may be made in keeping within the scope of the invention. For example, the objects on the top surface of the club head need not be simulated golf balls. Circle or even other geometrical shapes of various sizes could be used with similar results.

I claim:

1. A golf club including a putter type golf club head having a body, an upper surface on said body, and a ball striking face, and wherein the improvement comprises:

alignment means on said upper surface of said golf club head;

said alignment means being formed of a plurality of adjacent indicators each of which has substantially the same shape and diameter and corresponds generally to the appearance of a golf ball to be struck by said club head; each of said indicators being located along a line extending perpendicular to and in line with the center of said ball striking face and through the centers of said indicators;

whereby, in use, said plurality of indicators form an aiming line and said ball to be struck forms an extension of said aiming line.

2. The golf club head of claim 1 wherein said plurality of indicators are three-dimensional, hemispherically shaped forms.

3. The golf club head of claim 1 wherein said plurality of indicators are two-dimensional circular shaped forms.

4. The golf club head of claim 1 wherein said plurality of indicators are three.

5. The golf club head of claim 1 wherein said plurality of indicators include markings having the appearance of a plurality of golf ball dimples providing further the appearance of a golf ball.

6. The golf club head of claim 1 wherein said body is an elongated block.

7. The golf club head of claim 6 wherein said block is formed with a width having substantially the same dimension as the diameters of said indicators and the golf ball to be struck.

8. The golf club head of claim 7 wherein said indicators on said upper surface of said rectangular block are two-dimensional and circular shaped forms.

9. The golf club head of claim 1 wherein said body is a series of discs, the diameters of which are substantially the same as the diameters of said indicators and said golf ball to be struck.

10. The golf club head of claim 1 wherein said diameter of said indicators is approximately 1.68 inches.

11. A golf club head comprising an elongated body having a longitudinal axis, said body including an upper surface, a ball striking face formed on one end of said body, said ball striking face having a length substantially greater than the width of said elongated body and said ball striking face presenting a flat planar surface perpendicular to said longitudinal axis of said body, and wherein the improvement comprises:

alignment means on said upper surface of said golf club head; said alignment means being formed of a plurality of adjacent indicators each of which has substantially the same shape and diameter and corresponds generally to the appearance of a golf ball to be struck by said club head; each of said indicators being located along a line extending perpendicular to and in line with the center of said ball striking face and through the centers of said indicators;

whereby, in use, said plurality of indicators form an aiming line and said ball to be struck forms an extension of said aiming line.

12. The golf club head of claim 11 wherein said plurality of indicators are three-dimensional, hemispherically shaped forms.

13. The golf club head of claim 11 wherein said plurality of indicators include markings having the appearance of a plurality of golf ball dimples providing further the appearance of a golf ball.

14. The golf club head of claim 11 wherein said body is an elongated block.

15. The golf club head of claim 14 wherein said indicators on said upper surface of said elongated block are two-dimensional and circular shaped forms.

* * * * *